United States Patent [19]

Shiba et al.

[11] 3,930,863

[45] Jan. 6, 1976

[54] COLOR PHOTOGRAPHIC SENSITIVE MATERIAL

[75] Inventors: Keisuke Shiba; Takeshi Hirose; Toshiaki Aono; Reiichi Ohi; Tadao Shishido, all of Minami-ashigara, Japan

[73] Assignee: Fuji Photo Film Co., Ltd., Minami-ashigara, Japan

[22] Filed: Apr. 15, 1974

[21] Appl. No.: 461,087

[30] Foreign Application Priority Data

Apr. 13, 1973 Japan ..... 48-41870

[52] U.S. Cl. ..... 96/74; 96/22; 96/55; 96/76 R; 96/95; 96/100

[51] Int. Cl.[2] .. G03C 7/00; G03C 7/16; G03C 1/48; G03C 1/40

[58] Field of Search ..... 96/74, 76 R, 95, 22, 100, 96/55

[56] References Cited

UNITED STATES PATENTS

| | | | |
|---|---|---|---|
| 3,227,551 | 1/1966 | Barr et al. | 96/3 |
| 3,424,583 | 1/1969 | Seiter et al. | 96/74 |
| 3,620,746 | 11/1971 | Barr | 96/3 |
| 3,698,897 | 10/1972 | Gompf et al. | 96/3 |
| 3,700,453 | 10/1972 | Knechel | 96/74 |
| 3,725,062 | 4/1973 | Anderson et al. | 96/3 |

*Primary Examiner*—David Klein
*Assistant Examiner*—Alfonso T. Suro Pico
*Attorney, Agent, or Firm*—Sughrue, Rothwell, Mion, Zinn & Macpeak

[57] ABSTRACT

An incorporated-coupler type multi-layer color photographic sensitive material comprising a support and at least two photosensitive emulsion layers thereon which form images having a different color from each other on color development, wherein at least one of the photosensitive emulsion layers comprises two or more unit layers, with at least one of the unit layers containing a hydroquinone derivative. Interlayer color correction is obtained in the color photographic sensitive material.

14 Claims, 5 Drawing Figures

COLOR PHOTOGRAPHIC SENSITIVE MATERIAL

BACKGROUND OF THE INVENTION

1. Field of the Invention

The present invention relates to color photographic sensitive materials having improved color reproduction and particularly to color photographic sensitive materials wherein the quality of the color images are improved by using a compound which has an interlayer color correction effect.

2. Description of the Prior Art

Generally, in incorporated-coupler color photographic sensitive materials, non-diffusion type couplers are added to each photosensitive layer of the photosensitive materials so as to retain their independent functions. In general, these photosensitive materials comprise a photosensitive emulsion layer (BL) which contains a yellow coupler and is sensitive to blue light (rays having a wave length shorter than about 500 nm), a photosensitive emulsion layer (GL) which contains a magenta coupler and is sensitive to green light (rays having a wave length of about 500 to 600 nm) and a photosensitive emulsion layer (RL) which contains a cyan coupler and is sensitive to red light (visible rays having a wave length longer than about 590 nm). In these photosensitive materials, the BL, GL and RL must perform their functions independently. Therefore, the photosensitive materials further comprise middle layers (ML), filter layers (FL) for ultraviolet rays or for rays having a definite wave length range, antihalation layers (AHL) or protective layers (PL), thereby resulting in a superposed structure of two or more layers.

When excellent color reproduction is desired, the BL, GL and RL must perform their functions independently during production of such multi-layer color photographic sensitive materials, on storage of the unexposed sensitive materials or during image exposure and development. In addition, the BL, GL and RL must each have a coupler which has a preferred distribution of spectral sensitivity in a desired wave length range and forms a color image having suitable spectral absorption. However, color photographic sensitive materials developed at present have many defects.

A first defect in the color reproduction is in the spectral absorption characteristics of the developed images obtained by the coupler used. Namely, the coupler not only does not absorb sufficient light in a specific wave length range but also absorbs light in other wave length ranges, for example, in an undesired short or long wave length range. This defect is noticeable in yellow couplers, and in cyan couplers and is particularly noticeable in magenta couplers. This defect gives rise to a narrow color reproduction range, an aberration of the color tone and particularly a decrease of saturation.

A second defect is that color formation of the coupler in the adjacent photosensitive emulsion layer is caused at image development when a certain photosensitive emulsion layer is developed. For example, the cyan coupler in the RL sometimes colors on image development of the GL. This defect is caused by diffusion of the oxidation products of the color developing agent which are formed on development of a certain specified photosensitive layer into the adjacent photosensitive layer to cause coloring thereof in the adjacent photosensitive layer, or is induced by chemical development or physical development in the adjacent layer of the certain specified photosensitive layer.

A third defect is that the sensitizing dye used diffuses from the photosensitive emulsion layer to which it is specific to the adjacent photosensitive emulsion layer to cause sensitization of the latter layer resulting in an unsuitable distribution of spectral sensitivity.

Due to these defects, the color forming reaction in a certain specified photosensitive emulsion layer adversely influences the adjacent photosensitive emulsion layer which should function independently. This causes the formation of corresponding color images to cause an overlap with the color images of the specified photosensitive emulsion layer, the so-called "color mixing".

As methods of improving these defects, methods have been suggested for decreasing the "color mixing" itself, for example, to provide an ML and an FL or to add reducible compounds to the ML — for example, hydroquinone derivatives or phenol derivatives; scavengers for the oxidation products of the color developing agent; compounds which coupler to form colorless compounds or color couplers which form diffusible dyes; or agents for preventing diffusion of sensitizing dyes or couplers — for example, finely divided silver halide particles, colloidal silica — anionic, amphoteric, nonionic or cationic surface active agents, cationic hydrophilic polymers or polymer latexes, etc. However these approaches are not satisfactory.

Another method of improving the problem of "color mixing" is to introduce elements which have the function of "color correction."

A first such method comprises using colored couplers having a self-masking function. For example, known techniques and improvements therein are described in U.S. Pat. Nos. 2,449,966, 2,455,170, 2,600,788, 2,428,054, 3,148,062 and 2,983,608, and British Patent 1,044,778. However, this method can not be used for positive type color photosensitive materials because the method causes intense coloring in the non-exposed areas. This is because fog occurs due to the products formed by release of splitable azoaryl groups in the color development step and granularity of color images is deteriorated by such fog.

Secondly a method which comprises using the so-called "DIR coupler" is known. The term DIR coupler designates the couplers defined in C. R. Barr, J. R. Thirtle and P. W. Vittum, *Photographic Science and Eng.* Vol. 13, pages 74 –80 (1969) and 214 –217 (1969). By the use of the DIR coupler, effects caused by inhibition of development in the photosensitive emulsion layer used, such as an improvement of sharpness of color images by an edge effect or improvement of granularity, remarkably appear in predominance to the interlayer effect. It is known that the DIR coupler causes an interlayer effect. However, the DIR coupler has the defects that a deterioration of gradation (gamma) or a reduction of the maximum color density (D max) results because the DIR coupler causes a strong development inhibition effect in the centers of development depending on the image exposure - image development at the color development step. Accordingly, when the function of "color correction" related to the present invention must be effectively exhibited, it becomes necessary to use couplers which cause an interlayer effect which is stronger than the development inhibition effect in the layer. In the DIR coupler, the chemical structure of the compound which causes the effect in the layer rather than the interlayer effect can not be predicted from a mere knowledge of the chemical structure of the basic nucleus of known couplers or the chemical structure of splitable groups thereof. This is because the effect of "color correction" appears as a result of complicated factors such as the rate of the releasing coupling reaction of the DIR coupler, the development inhibition activity of the release splitable group, the diffusion property of the released splitable group in the photosensitive layer, the developing rate of each coexistent photosensitive emulsion itself, the coupling activity of the coupler coexistent or existent in other layers, the mutual interaction with compounds coexistent in the ML or the FL or the spectral absorption characteristic of colored dyes, or a combination of these factors.

The DIR coupler produces color dyes by color development. Accordingly, it is necessary that the colored dyes produced satisfy the requirements for the photosensitive layers used, and thus the DIR coupler has limited uses. Colorless DIR couplers are known and are described, for example, in U.S. pat. No. 3,632,345, and German Patent Publication (OLS) No. 2,060,196, etc. However, such a coupler has the tendency to contaminate if the photosensitive material used is stored for a long period of time.

Thirdly, a method which comprises using substantially fogged emulsions or direct positive emulsions, a method which comprises using internally fogged emulsions or internal latent image emulsions and a method which comprises utilizing the Luckey effect are known. However, these methods which comprise using such silver halide emulsions are accompanied by a reduction in sharpness due to the light scattering of their particles upon exposure, difficulties in controlling the photographic property of the emulsions and photographic subordinate actions.

Fourthly, a method of controlling the composition of each silver halide emulsion itself, such as the BL, GL or RL used in the superposed structure, for example the proportion of iodine ion content and bromine ion content, or controlling the interlayer distribution of materials having a development inhibiting property and controlling the interlayer distribution of materials having a developnent accelerating property in the antifogging agent or stabilizer used are known. However, sufficient "color correction" effect using these means is not obtained.

In addition, factors in the development treating process, for example, the developing agent content, the halogen ion content, the sulfide ion content and the hydrogen ion concentration in the developer, the buffer properties thereof and the degree of fatigue thereof, etc., are included. The effect of "color correction" by these factors also is not sufficient.

The above described hydroquinone derivatives react as a reducible compound and as a reducing agent for the color development agent in an oxidized state to render the products inactive to couplers and thus "color mixing" decreases. However, if the hydroquinones are present with the coupler, they inhibit color formation of the couplers to cause a reduction of D max or a loss of toe gradation.

It is known that hydroquinone derivatives are included in photosensitive emulsions as an activator for development. They are particularly used in black-white photosensitive materials. The hydroquinone derivatives function as a developing agent in black-white development. However, in color development of the photosensitive materials where they coexist with couplers, they function to inhibit color development. Accordingly, it is known that the function of the hydroquinone derivatives is quite different between their use in photosensitive materials for forming images by black-white development and their use in color development or between their use in photosensitive materials where they are coexistent with the couplers and where they are used in a very large amount in photosensitive materials.

Hydroquinone derivatives are known and used as IRD (inhibitor-releasing developers), for example, as described in U.S. Pat. No. 3,379,529. An IRD is a developer per se. Namely, an IRD is a developer which activates development and consequently releases an inhibitor. Accordingly, an IRD is useful in black-white development when it is used in a very large amount as compared with the couplers in the present invention. The function of an IRD remarkably deteriorates in color development when it is used in an amount comparable with the amount of couplers commonly used.

U.S. Pat. No. 3,620,746 discloses that hydroquinone derivatives are used as DIR hydroquinones. The disclosure of U.S. Pat. No. 3,620,746 relates to specified color photographic materials for recording light images on a braun tube for radar use (a phosphor-coated radar screen), which is characterized by using an anti-diffusion coupler and the so-called DIR coupler (developing inhibitor-releasing hydroquinone compound) in silver halide emulsions containing additionally fine silver halide grains and having a more rapidly developing property and particularly in chlorobromide emulsions. However, this element can not be used for improving the color reproduction, which is one of the objects of the present invention. In a color photographic sensitive material, if a specific photosensitive emulsion layer has the property of developing more rapidly, a gradation balance between the other photosensitive emulsion layers changes to result in very bad color reproduction. If it is not carried out according to the description of U.S. Pat. No. 3,620,746, namely if more rapidly developable emulsions are not used, not only does the effect described in the above described patent not appear but also the graduation and the D max of the colored images of the photosensitive layer containing the DIR hydroquinone deteriorates.

SUMMARY OF THE INVENTION

A first object of the present invention is to provide color photographic sensitive materials having improved color reproduction by applying an interlayer color correction function.

A second object is to provide a novel method of applying a color correction effect using hydroquinone derivatives for interlayer color correction.

A third object is to provide a method of improving the many photographic defects caused when the so-called "DIR hydroquinone compound" is used, These and other objects can be attained in the present invention as follow. Namely, the objects of the present invention are attained with an incorporated coupler type multilayer color photographic sensitive material comprising a support having thereon at least two photosensitive emulsion layers which form color images having a different color tone from each other, wherein at least one of the photosensitive emulsion layers comprises two or more unit layers and at least one of the unit layers contains a hydroquinone derivative. The material possesses interlayer color correction.

BRIEF DESCRIPTION OF THE ACCOMPANYING DRAWINGS

DETAILED DESCRIPTION OF THE INVENTION

Figure 1:
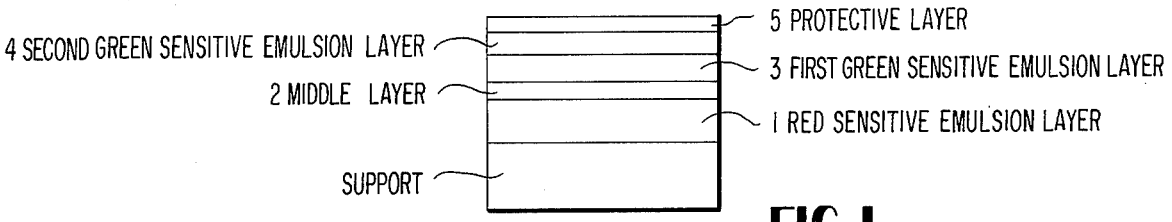
FIGS. 1 to 3 are sectional views which each show an embodiment of the photosensitive materials according to the present invention.

The term "unit" as used herein designates an assembly of one or more emulsion layers (unit layers) which are sensitive to the same wavelength region. When a unit comprises two or more emulsion layers, the emulsion layers can be contignous to each other and/or a second unit of emulsion layers, intermediate layers, other layers having various purposes, etc., can be positioned therebetween.

It is preferred that the hydroquinone derivative for interlayer color correction be included in an amount up to about 50% by mol. e.g., 1 to 50% by mol, preferably 5 to 20% by mol, based on the coupler included in the layer to be added. The amount of the hydroquinone derivative in each unit layer of the photosensitive layer which renders substantially the same color can be suitably varried.

In the color photographic sensitive materials according to the present invention, each of the photosensitive emulsion layers used have substantially the same developing rate. Further, the unit layers of one photosensitive emulsion layer have also a developing property of substantially the same rapidity as each other. This is necessary for improving color reproduction in the present invention. The unit layers may have different properties from each other. For example, first, it is possible to expand an exposure range of gradation reproduction by rendering each differently sensitive. Second, it is possible to improve the granularity of color images by incorporating silver halide in a high sensitive unit layer at a higher concentration than in the low sensitive unit layer and by incorporating a coupler in a molar ratio less than the silver halide. Third, it is possible to effectively mask by incorporating a colored coupler in at least one unit layer without causing defects of the colored coupler to occur, Fourth, it is possible to add a two-equivalent coupler at a desired concentration. Fifth, it is possible to add sensitizers, for example, onium compounds or polyalkylene oxide derivatives, and inhibitors, for example, those described in U.S. Pat. Nos. 2,271,623, 2,288,226, 2,334,864, 2,708,162, 2,531,832, 2,533,990, 3,310,191 and 3,158,484 at a desired concentration.

The hydroquinone derivatives for interlayer color correction in the present invention release a diffusible color development inhibitor at color development and selectively inhibit color development of an adjacent photosensitive emulsion layer. Consequently, they exhibit a high interlayer color correction effect as compared with a development inhibiting effect in the layer. It is believed that they are oxidized by a color developing agent in an oxidized state formed on color development and inhibiting residues combined with the hydroquinone derivatives are released by an addition reaction of the coexistent sulfite ions.

The hydroquinone derivatives for interlayer color correction (ICC) in the present invention include compounds known as the so-called IRD (inhibitor-releasing developer) or the so-called DIF (development inhibitor-releasing) hydroquinones. For example, they include compounds described in U.S. Pat. Nos. 3,379,529, 3,364,022 and 3,620,746.

Particulary, hydroquinone compounds represented by the followingn formula (I) are preferably used.

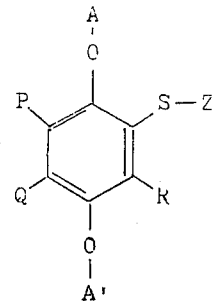

(I)

In the formula, P,Q and R each represents a hydrogen atom, an alkyl group (e.g., having 1 to 18 carbon atoms such as methyl, ethyl, octyl, tridecyl and the like), an alkenyl group (e.g., having 2 to 18 carbon atoms such as allyl, octadecenyl and the like), a hydroxyl group, and alkoxy group (e.g., having 1 to 18 carbon atoms such as methoxy, ethoxy and the like), an amino group (e.g., an amino group or a substituted amino group having 1 to 30 total carbon atoms such as diethylamino, phenylamino, octadecylamino and the like), an alkylthio group (e.g., nonylthio, tridecylthio and the like), an aryl group (e.g. phenyl, tolyl, and the like), an arylthio group (e.g. phenylthio, tolylthio and the like), a halogen atom, a heterocyclic group (e.g. tetrazolyl, thiazolyl, quinonyl and the like) or a —SZ group (e.g., tetrazolylthio, thiadiazolylthio and the like), and P and Q can combine to form a carbocyclic ring group (e.g., a benzen ring group or a tetrahydrobenzene ring group). A and A' each represents a hydrogen atom or alkaline splitable group selected from acyl groups and alkoxycarbonyl groups (e.g., having 1 to 8 carbon atoms such as acetyl, phenoxycarbonyl, methoxycarbonyl, etc.). Z represents a heterocyclic residue which is photographically inactive in a combined state and which can be released at development, and particularly a heterocyclic aromatic group such as a tetrazolyl group (e.g., 1-phenyltetrazolyl, 1-alkoxphenyl-tetrazolyl and the like), a triazolyl group (e.g., 1-phenyl, 3-n-amyl, 1,2,4-triazolyl and the like), a thiadiazolyl group (e.g., 5-methylthio-thiadiazolyl, 5 propylthiadiazolyl and the like), an oxazolyl group (e.g. 4-methyloxazoyl, benzoxazolyl, β-naphthoxazolyl and the like), an oxadiazolyl group, a thiazolyl group or a pyrimidyl group.

It is possible to render these ICC-hydroquinone derivatives diffusion resistant by combinig them with polymers by a ballasting group through P, Q or R or by a residue of P, Q or R. For example, these ICC-hydroquinone derivatives (I) can be rendered diffusion resistant by P, Q or R containing a ballasting group, e.g., a hydrophobic group having 8 to 32 carbon atoms. It is also possible to render the hydroquinone derivatives (I) diffusion resistant by combining them with polymer residues through the P, Q or R group.

Examples of suitable compounds are as follows. However, the invention is not to be interpreted as being limited to these examples.

Compound A 2-(2′-Methylthio-1′, 3′, 4′-thiadiazol-5′-ylthio)-6-(1″, 1″, 3″, 3″-tetramethylbutyl)hydroquinone.

Compound B 3-(2′-Methylthio-1′, 3′, 4′-thiadiazol-5-ylthio)-6-(1″, 1″, 3″, 3″-tetramethylbutyl)hydroquinone.

Compound C 2,3-bis-(2′-Methylthio-1′, 3′, 4′-thiadiazol-5′-ylthio)-6-(1″, 1″, 3″, 3″-tetramethylbutyl)-hydroquinone, Compound D 2-(5′-n-Pentyl-4′-phenyl-1′, 2′, 4′-triazol-3′-ylthio)-5-(1″, 1″, 3″, 3″-tetramethylbutyl)-hydroquinone.

Compound E 2-(6′-Methyl-1′, 3′, 3a′, 7′-tetraazainden-4′-ylthio)-6-(1″, 1″, 3″, 3″-tetramethylbutyl)-hydroquinone.

Compound F 2,3-bis-(6′-Methyl-1′, 3′, 3a′, 7′-tetraazainden-4′-yl)thio6-(1″, 1″, 3″, 3″-tetramethylbutyl)-hydroquinone.

Compound G 2-(4′-Phenyl-1′, 2′, 4′-triazol-5′-ylthio)-5-(1″, 1″, 3″, 3″-tetramethylbutyl)-hydroquinone.

Compound H 2-(1′-Phenyl-tetrazol-5′-ylthio)-5-(1″, 1″, 3″, 3″-tetramethyl-butyl)-hydroquinone.

Compound I 2-(1′-Phenyl-tetrazol-5′-ylthio)-6-(1″, 1″, 3″, 3″-tetramethyl-butyl)-hydroquinone.

Compound J 2-(1′-Phenyl-tetrazol-5′-ylthio)5-n-dodecylthio-hydroquinone.

Compound K 2-(1′-Phenyl-tetrazol-5′-ylthio)-5-n-octadecylthio-hydroquinone.

Compound L

2′-Carboxy-phenylthio-5-(1″, 1″, 3″, 3″-tetramethylbutyl)-hydroquinone.

Compound M

2-Phenylthio-3-(1′-phenyl-tetrazol-5′-ylthio)-5-n-dodecylthio-hydroquinone.

The above described compounds can be synthesized using the method described in U.S. Pat. No. 3,379,529. In the following, a process for the synthesis of representative compounds is described in the following examples. Unless otherwise indicated herein, all parts, percents ratios and the like are by weight.

Synthesis 1 (Synthesis of Compound D)

13g of 3-mercapto-5-n-pentyl-4-phenyl-1,2,4-triazole was dissolved in 200ml of methanol and the resulting solution was stirred while cooling with ice. To this solution, 12g of 2-(1′, 1′, 3′, 3′-tetramethylbutyl)-benzoquinone was slowly added. After the addition, the stirring was continued for 2 hours while cooling with ice, and the mixture was allowed to stand over night at room temperature (about 20 – 30°C). After removing the methanol in vacuum, 20ml of diethylether was added to the residue. The resulting crystals were separated by filtration and recrystallized from ethyl acetate to produce 5g of 2-(5′-n-pentyl-4-phenyl-1′, 2′, 4′-triazol-3′-ylthio)-5-(1″, 1″, 3″, 3″-tetramethylbutyl)-hydroquinone having a melting point of 198°C.

Synthesis 2(Synthesis of Compound J)

44g of p-benzoquinone and 20g of dodecylmercaptan were dissolved in 500ml of methanol, and the resulting solution was stirred at room temperature to precipitate crystals. The crystals were separated by filtration, washed with methanol and dried to produce 30g of 2-dodecylthio-p-benzoquinone. 30g of the resulting crystals and 36g of phenylmercaptotetrazole were reacted in 500ml of methanol under reflux. The reaction mixture was poured into water and the precipitated crystals were separated by filtration and recrystallized from methanol. Yield: 40g. Melting point: 131 – 132°C.

The couplers used in the present invention are 4-equivalent or 2-equivalent anti-diffusion type couplers as are conventionally used in photographic elements. Particularly, 2-equivalent couplers are useful, which include uncolored couplers for interlayer color correction as described in Japanese Patent Application No. 33238/1973 or colored couplers.

Examples of magenta couplers are magenta couplers such as the 5-pyrazolones, the cyanoacetylcoumarones and the indazolones as disclosed in U.S. Pat. Nos. 2,600,788; 2,801,171; 2,908,573; 2,983,608; 3,046,129; 3,062,653; 3,227,554.

Of the magenta couplers, those represented by the following general formula (II) are particularly useful;

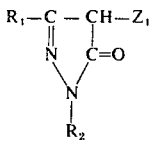

(II)

wherein $R_1$ represents an alkyl group (e.g., having 1 to 18 carbon atoms) such as a primary, secondary or tertiary alkyl group (e.g., methyl, propyl, n-butyl, t-butyl, hexyl, 2-hydroxyethyl, 2-phenylethyl, etc.), an aryl group (e.g., phenyl, tolyl, m-acylaminophenyl etc., an alkoxy group (e.g., methoxy, ethoxy, benzyloxy, etc.), an aryloxy group (e.g., phenoxy, 3,3′-dialkoxycarbonylphenoxy, etc.), a hetero ring (e.g., quinolinyl, pyridyl, piperidyl, benzofuranyl, oxazolyl, etc.), an amino group (e.g., methylamino, diethylamino, dibutylamino, phenylamino, tolylamino, 4-(3-sulfobenzamino)anilino, 2-chloro-5-acylaminoanilino, 2-chloro-5-alkoxycarbonylanilino, 2-trifluoromethylphenylamin, etc.), an amido group (e.g., alkylcarbonamido, arylcarbonamido, heterocyclic carbonamido, sulfonamido, alkylsulfonamido, arylsulfonamido, heterocyclic sulfonamido, etc.), an ureido group (e.g., alkylureido, arylureido, heterocyclic ureido, etc.), and $R_2$ represents an aryl group (e.g., naphthyl, phenyl, 2,4,6-trichlorophenyl, 2-chloro-4,6-dimethylphenyl, 2,6-dichloro-4-methoxyphenyl, 4-methylphenyl, 4-acylaminophenyl, 4-alkylaminophenyl, 4-trifluoromethylphenyl, 3,5-dibromophenyl, etc.), a heterocyclic group (e.g., benzofuranyl, naphthoxazolyl, quinolinyl, etc.), an alkyl group such as a primary, secondary or tertiary alkyl group (e.g., methyl, ethyl, t-butyl, benzyl, etc.), and the like. $Z_1$ represents a hydrogen atom or a group splitable at color development as described in U.S. Pat. Nos. 3,419,391, 3,252,924, 3,311,476 or 3,227,550 or Japanese Patent Publication No. 33238/1973 such as a thiocyano group, an acyloxy group, an aryloxy group, an alkoxy group, an alkoxycarbonyloxy group, an aryloxycarbonyloxy group, a di-substituted amino group, an arylazo group or a heterocyclic azo group, etc., or a group described in U.S. Pat. Nos. 3,148,062, 3,227,554, 3,615,506 or 3,701,783 such as an aryl monothio group (e.g., 2-aminophenylthio, 2-hydroxycarbonylphenylthio and the like), a heterocyclic monothio group (e.g., tetrazolyl group, triazinyl group, triazolyl group, oxazolyl group, oxadiazolyl group, diazolyl group, thiazyl group, thiadiazolyl group and the like), or a heterocyclic imido group (e.g., 1-triazolyl group, 1-imidazolyl group, 2-benzotriazolyl group and the like).

In addition, yellow couplers such as the open-chained acyalcetonitrile yellow couplers, the acylacetyl yellow couplers and the open-chained acylacetanilide yellow couplers (e.g., pivalylacetanilide couplers, aroylacetanilide couplers, acylacetanilide couplers, etc.) are included, for example as described in U.S. Pat. Nos. 2,875,057; 2,908,573; 3,406,129; 3,227,155; 3,265,506; 3,384,657; 2,778,658; 3,253,924; 3,227,550; 3,227,554.

Of the yellow couplers, those represented by the following general formula (III) are particularly useful;

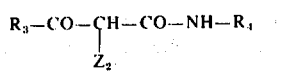

$$R_3-CO-\underset{\underset{Z_2}{|}}{CH}-CO-NH-R_4 \qquad \text{(III)}$$

wherein $R_3$ represents a primary, secondary or tertiary alkyl group having 1 to 18 carbon atoms (e.g., t-butyl, 1,1-dimethylpropyl, 1,1-dimethyl-1-methoxphenoxymethyl, 1,1-dimethyl-1-ethylthiomethyl, etc.) or an aryl group (e.g., phenyl, alkylphenyl such as 3-methylphenyl or 3-octadecylphenyl, alkoxphenyl such as 2-methoxphenyl or 4-methoxyphenyl halophenyl, 2-halo-5-alkamidophenyl, 2-chloro-5-[α-(2,4-di-t-amylphenoxy)butylamido]phenyl, 2methoxy-5-alkamidophenyl, 2-chloro-5-sulfonamidophenyl, etc.), $R_4$ represents a phenyl group (e.g., 2-chlorophenyl, 2-halo-5-alkamidophenyl, 2-chloro-5-[α-(2,4-di-t-amylphenoxy)acetamido]phenyl, 2-chloro-5-(4-methylphenylsulfonamido)phenyl, 2-methoxy-5-(2,4-di-t-amylphenoxy)acetamidophenyl, etc. $Z_2$ represents a hydrogen atom or a group which is splitable at color development such as a halogen atom, and particularly a fluorine atom, an acyloxy group, an aryloxy group, a heterocyclic aromatic carbonyl oxy group, an arylsulfoxy group, a dioxoimido group such as a phthalimide group, a dioxyimidazolidinyl group, a dioxyoxazolidinyl group, and a imidazolyl group, or a dioxythiazolidinyl group and the like, as described in U.S. Pat. Nos. 3,227,550, 3,253,924, 3,277,155, 3,265,506, 3,408,194 and 3,415,652, French Pat. No. 1,411,384, British Pat. Nos. 944,490, 1,040,710, and 1,118,028, and German Patent Publications (OLS) Nos. 2,057,941, 2,163,812, 2,231,461 and 2,219,917.

As cyan couplers, naphthol couplers and phenol couplers can be used, for example, as disclosed in U.S. Pat. Nos. 2,423,730; 2,474,293; 2,521,908, etc. Particularly, those couplers represented by the following formulae (IV) and (V) are useful.

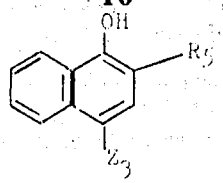

(IV)

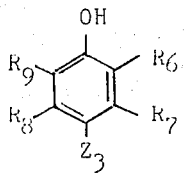

( V)

In the formula, $R_5$ represents a substituent generally used in cyan couplers, such as a carbamyl group (e.g., alkylcarbamyl, arylcarbamyl such as phenyl-carbamyl, a heterocyclic carbamyl such as benzothiazolyl carbamyl and the like), sulfamyl group (e.g., alkylsulfamyl, arylsulfamyl such as phenyl sulfamyl, heterocyclic sulfamyl and the like), an alkoxycarbonyl group or an aryloxycarbonyl group. $R_6$ represents an alkyl group, an aryl group, a heterocyclic group, an amino group (amino, alkylamino, arylamino and the like), a carboxyamido group (e.g., alkylcarboxamido, arylcarboxamido and the like, a sulfonamido group, a sulfamyl group (e.g., alkylsulfamyl, arylsulfamyl and the like) or a carbamyl group. $R_7$, $R_8$ and $R_9$ each represents the same groups as defined for $R_6$, a halogen atom or an alkoxy group. $Z_3$ represents a hydrogen atom or a group which is splitable at color development such as a halogen atom, a thiocyano group, an imino group, a cycloimido group (e.g., maleimido, succinimido, 1,2-dicarboximido and the like), an arylazo group or a heterocyclic azo group.

Examples of couplers which can be used in the present invention are described in the following. However, the invention is not to be construed as being limited to these coupler compounds.

Yellow Couplers

1. α-{3-[α-(2,4-Di-tert-amylphenoxy)butylamido]-benzoyl}-2-methoxyacetanilide.
2. α-Acetoxy-α-3-[γ-(2,4-di-tert-amylphenoxy)-butylamido]-benzoyl-2-methoxyacetanilide.
3. α-{3-[α-(2,4-Di-tert-amylphenoxy)butylamido]-benzoyl}-2-chloroacetanilide.
4. α-(2,4-Dioxo-5,5-dimethyloxazolidinyl)-α-pivaloyl-2-chloro-5-[α-(2,4-di-tert-amylphenoxy)-butylamido[acetanilide.
5. α-(4-Carboxyphenoxy)-α-pivaloyl-2-chloro-5-[α-(2,4-di-tert-amylphenoxy)bytylamido]acetanilide.
6. α-{3-(1-Benzyl-2,4-dioxo)hydantoin}-α-pivaloyl-2-chloro-5-{α-(2,4-di-tert-amylphenoxy)-butylamido}acetanilide.
7. α-Benzoyl-α-(2-benzothiazolylthio)-4-[N-(γ-phenylpropyl)-N-(4-tolyl)sulfamyl]actanilide.

Magenta Couplers 8. 1-(2,4,6-Trichlorophenyl)-3-[3-(2,4-di-tert-amylphenoxyacetamido)benzamido]-5-pyrazolone.
9. 1-(2,4,6-Trichlorophenyl)-3-{3-[α-(2,4-di-tert-amylphenoxy)-acetamido]benzamido}-4-acetoxy-5-pyrazolone.

10. 1-(2,4,6-Trichlorophenyl)-3-hexadecanamido-4-(4-hydroxyphenyl)-azo-5-pyrazolone.
11. 1-(2,4,6-Trichlorophenyl)-3-(3-tridecanoylamino-6-chloro)-anilino-5-pyrazolone.
12. 1-(2,4,6-Trichlorophenyl)-3-(3-tetradecyloxycarbonyl-6-chloro)anilino-4-(1-naphthylazo)-5-pyrazolone.
13. 1-(2,4-Dichloro-6-methoxyphenyl)3-[(3-tridecanoylamino-6-chloro)anilino]-4-benzyloxycarbonyloxy-5-pyrazolone.
14. 1-{4-[γ-(2,4-Di-tert-amylphenoxy)butylamido]-phenyl}-3-piperidinyl-4-(1-phenyl-5-tetrazolylthio)-5-pyrazolone.
15. 1-{4-[α-(2,4-Di-tert-amylphenoxy)acetamido]-phenyl}-3-methyl-4-(5- or 6-bromo-1-benzotriazolyl)-5-pyrazolone.

Cyan Couplers 16. 1-Hydroxy-N-[γ-(2,4-di-tert-amylphenoxy)-propyl]-2-naphthamide.
17. 1-Hydroxy-4-[2-(2-hexyldecyloxycarbonyl)-phenylazo]-2-[N-(1-naphthyl)]naphthamide.
18. 1-Hydroxy-4-chloro-N-[α-(2,4-di-tert-amylphenoxy)butyl]-2-naphthamide.
19. 5-Methyl-4,6-dichloro-2-[α-(3-n-pentadecylphenoxy)butylamido]phenol.
20. 1-Hydroxy-4-iodo-N-dodecyl-2-naphthamide.
21. 5-Methoxy-2-[α-(3-n-pentadecylphenoxy)-butylamido]-4-(1-phenyl-5-tetrazolylthio)phenol.
22. 1-Benzyl-3-[2-chloro-5-(tetradecanamido)anilino]-4-(5- or 6-methyl-1-benzotriazolyl)-5-pyrazolone.
23. 1-{4-[α-(2,4-Di-tert-amylphenoxy)acetamido]-phenyl}-3-ethoxy-4-(5- or 6-bromo-1-benzotriazolyl)-5-pyrazolone.

The couplers which can be used in the present invention are roughly classified as Fischer couplers having water solubilizing groups such as a carboxyl group, a hydroxy group, a sulfo group and the like and as hydrophobic couplers. The couplers can be incorporated using known methods of addition to emulsions or dispersion in emulsions of hydrophilic colloids. For example, the method of dispersing the couplers which comprises mixing a coupler with an organic solvent having a high boiling point (e.g., above about 175°C) such as dibutyl phthalate, tricresyl phosphate, waxes, higher fatty acids and esters thereof, described, for example, in U.S. Pat. Nos. 2,304,939 and 2,322,027, the method of dispersing the couplers which comprises mixing a coupler with an organic solvent having a low boiling point (e.g., less than 120°C) or with a water miscible organic solvent or the method of dispersing the couplers using an organic solvent having a high boiling point together with an organic solvent having a low boiling point or a water miscible organic solvent, described, for example, in U.S. Pat. Nos. 2,801,170, 2,801,171 and 2,949,360, and the method of dispersing a coupler alone or together with other couplers such as a colored coupler or an uncolored coupler where the coupler has a sufficiently low melting point (e.g., 75°C or less) described in German Pat. No. 1,143,707 can be utilized.

As dispersion assistants, anionic surface active agents (e.g., sodium alkylbenzene sulfonate, sodium dioctylsulfosuccinate, sodium dodecyl sulfate, sodium alkylnaphthalene sulfonate, Fischer couplers and the like), amphoteric surface active agents (e.g., N-tetradecyl-N,N-dipolyethylene-α-betaine and the like) and nonionic surface active agents (e.g., sorbitan monolaurate and the like) can be used.

The emulsions which can be used in the present invention are silver halide photographic emulsions which contain silver chloride, silver bromide, silver iodide or mixed silver halide particles in a hydrophilic colloid.

A characteristic feature of the photosensitive emulsions of the present invention lies in the development procession. Namely, in each photosensitive emulsion layer of the color photographic sensitive material having a multilayer structure, procession of development thereof is uniform from the beginning of the development to the end of the development. The rate of development in the silver halide emulsions depends upon not only a composition of the halides but also on the manner of chemical ripening or degree thereof. Further the procession of development at color development, greatly depends upon the kind of coupler coexistent with the silver halide emulsion. Another characteristic feature of the color photographic sensitive materials of the present invention is in the multilayer structure employed. Namely, by dividing the photosensitive emulsion layer into at least two layers, a color correction effect can be obtained while the deterioration of the gradation in the use of 1 cc of hydroquinone, the lowering of the D max or the decrease of the sensitivity of the photosensitive emulsion layer is prevented.

Examples of hydrophilic colloids which can be used in the present invention include gelatin, cellulose derivatives, alginates, hydrophilic synthetic polymers such as polyvinyl alcohol, polyvinylpyrrolidone, polystyrene sulfonate and the like. In addition plasticizers which improve the dimension stability of films, and polymer latexes such as of polymethyl methacrylate and polyethyl acrylate, etc. can be used.

The silver halide emulsions used in the present invention can be sensitized using conventional chemical sensitization techniques. For example, the emulsions can be treated using the gold sensitization method described in U.S. Pat. Nos. 2,399,083, 2,597,856 and 2,597,915, the reduction sensitization method described in U.S. Pat. Nos. 2,478,850 and 2,521,925, the sulfur sensitization method described in U.S. Pat. Nos. 1,623,499 and 2,410,689, the method of sensitization using other metal ions described in U.S. Pat. Nos. 2,448,060, 2,566,245 and 2,566,263, or using a combination of these methods.

Spectral sensitization methods conventionally used in color photographic sensitive materials as disclosed in U.S. Pat. Nos. 2,493,748; 2,519,001; 2,977,229; 3,480,434; 3,672,897; 3,703,377; 2,688,545; 2,912,329; 3,397,060; 3,615,635; 3,628,964; 3,511,664; 3,522,052; 3,527,641; 3,615,613; 3,615,632; 3,617,295; 3,635,721; 3,694,217; etc. can also be utilized. In addition, conventionally used stabilizers such as 4-hydroxy-1,3,3a, 7-tetrazaindene derivatives, antifogging agents such as mercapto compounds, benzotriazole derivatives, etc., can be used. Suitable stabilizers and anti fogging agents are disclosed in, e.g., U.S. Pat. Nos. 1.758,576; 2,110,178; 2,131,038; 2,173,628; 2,697,040; 2,304,962; 2,324,123; 2,394,198; 2,444,605-8; 2,566,245; 2,694,716; 2,697,099; 2,708,162; 2,728,663-5; 2,476,536; 2,824,001; 2,843,491; 2,886,437, 3,052,544; 3,137,577; 3,220,839; 3,226,231; 3,236,652; 3,251,691; 3,252,799; 3,287,135; 3,326,681; 3,420,668; 3,622,339; etc. The emulsions can also contain coating assistants, e.g., as described in U.S. Pat.

Nos. 2,271,623; 2,240,472; 2,288,226; 2,739,891; 3,068,101; 3,158,484; 3,201,253; 3,210,191; 3,294,540; 3,415,649, 3,441,413; 3,442;654; 3,475,174; 3,545,974, etc., hardening agents e.g., as described in U.S. Pat. Nos. 3,288,775; 2,732,303; 3,635,718; 3,232,763; 2,732,316; 2,586,168; 3,017,280; 2,983,611; 2,725,294; 2,725,295; 3,100,704; 3,091,537; 3,321,313; etc., wetting agents and sensitizers such as onium derivatives such as quaternary ammonium salts described in U.S. Pat. Nos. 2,271,623; 2,288,226 and 2,334,864 and polyalkyleneoxide derivatives described in U.S. Pat. Nos. 2,708,162; 2,531,832; 2,533,990; 3,210,191 and 3,158,484 can be incorporated in the photosensitive materials. Furthermore, dyes for preventing irradiation can be added, and filter layers, mordant dye layers and color layers containing hydrophobic dyes can be included as layer members of the color photographic sensitive materials of the present invention.

The photosensitive emulsions used in the present invention can be applied to many kinds of supports. Examples of such supports are cellulose acetate films, polyethylene terephthalate films, polyethylene films, polypropylene films, glass plates, barita paper, resin laminated paper and synthetic paper.

The photographic sensitive materials of the present invention are treated with color developers which contain conventionally employed color developing agents such as p-phenylenediamine derivatives, p-aminophenol derivatives and the like. Examples of preferred p-phenylenediamine derivatives include p-amino-N-ethyl-N-$\beta$-(methane sulfoamidoethyl)-m-toluidine sesquisulfate monohydrate, diethylamino-p-phenylenediamine sesquisulfite, p-amino-N,N-diethyl-m-toluidine hydrochloride, p-amino-N-ethyl-N-$\beta$-hydroxy-ethylaniline sesquisulfate monohydrate and the like. Further, known developers for color negative sensitive materials, color negative or positive sensitive materials for movie, color paper or instant color sensitive materials can be used. For example, the color development treatments described in Japanese Patent Publication 35749/1970, Japanese Patent Applications No. 67798/1969, 13313/1971 and 19516/1971; H. Gordon, *The British Journal of Photography*, Nov. 14, 1954, p. 558; *ibid.*, Sept. 9, 1955, p. 440; and *ibid.*, Jan. 6, 1956, p. 2; S. Horwitz, *ibid.*, Apr. 22, 1960, p. 212; E. Gehret, *ibid.*, Mar. 4, 1960, p. 122; and *ibid.*, May 7, 1965; p. 396; and J. Meech, *ibid.*, Apr. 3, 1959, p. 182, and German Patent Publication (OLS) 2,238,051 can be utilized.

The present invention will be illustrated in greater detail by reference to the following examples. However, the present invention is not to be construed as being limited to these examples. These examples facilitate a further understanding of the characteristics and techniques of application to the present invention. Unless otherwise indicated, all parts, percents, ratios and the like are by weight.

EXAMPLE 1

Sample A was produced by applying the following coatings to a transparent cellulose triacetate film support so as to produce 5 layers as shown in FIG. 1. The compositions of the coatings used for forming each layer and the production techniques employed were as follows.

First Layer: Red Sensitive Emulsion Layer 1 kg of a silver iodobromide emulsion (silver content: 0.6 mols, iodine content: 6 % by mol) was spectrally sensitized using $4 \times 10^{-5}$ mols/mol of silver of Sensitizing Dye I and $1 \times 10^{-5}$ mols/mol of silver of Sensitizing Dye II. 100 g of Coupler (16) was dissolved in a mixture of 100 cc of tricresyl phosphate and 200 cc of ethyl acetate and the solution was emulsified in 1 kg of a 10 % gelatin solution using 4 g of sodium nonylbenzene sulfonate to produce Emulsion I. 550 g of this emulsion was added to the above described sensitized silver halide emulsion and then an aqueous solution of 2 g of sodium 2,4-dichloro-6-hydroxytriazine was added thereto with stirring. The amount of silver coated in the first layer was 1.7 g/m$^2$.

Second Layer: Intermediate Layer 1 kg of a 10 % aqueous gelatin solution was prepared. 50 g of 2,5-di-t-octylhydroquinone was dissolved in 100 cc of tricresyl phosphate. This solution was emulsified in 1 kg of the above described 10 % aqueous gelatin solution in the same manner as in Emulsion I. To 250 g of this emulsion, an aqueous solution of 2 g of sodium 2,4-dichloro-6-hydroxytriazine was added with stirring. The dry thickness of the intermediate layer was about 0.7 $\mu$.

Third Layer: First Green-Sensitive Emulsion Layer 1 kg of a silver iodobromide emulsion (the same as in the first layer) was spectrally sensitized using $3 \times 10^{-5}$ mols/mol of silver of Sensitizing Dye III and $1 \times 10^{-5}$ mols/mol of silver of Sensitizing Dye IV. Emulsion II was produced using 100 g of Coupler (8) in the same manner as in Emulsion I. 500 g of Emulsion II was added to the sensitized emulsion to produce an emulsion in the same manner as in the first layer. The amount of silver coated in the third layer was 1.5 g/m$^2$.

Fourth Layer: Second Green-Sensitive Emulsion Layer 1 kg of a silver iodobromide emulsion (silver content: 0.7 mols, iodine content: 6 % by mol) was spectrally sensitized using $2.5 \times 10^{-5}$ mols/mol of silver of Sensitizing Dye III and $0.8 \times 10^{-5}$ mols/mol of silver of Sensitizing Dye IV. 72 g of Coupler (8) and 28 g of Coupler (10) were dissoved in a mixture of 100 cc of tricresyl phosphate and 200 cc of ethyl acetate and the solution was emulsified in 1 kg of a 10 % gelatin solution using 4 g of sodium nonylbenzene sulfonate to produce Emulsion III. 150 g of this emulsion was added to the above described sensitized emulsion to produce an emulsion in the same manner as in the first layer. The amount of silver coated in the fourth layer was 1.7 g/m$^2$.

Fifth Layer: Protective Layer 0.2 g of sodium nonylbenzene sulfonate was added to 1 kg of a 10 % gelatin solution. The dry thickness of the protective layer was about 1.7 $\mu$.

Sensitizing dyes used for producing Sample A.

Sensitizing Dye I: Anhydro-5,5'-dichloro-3,3'-di-sulfopropyl-9-ethyl-thiacarbocyanine Hydroxide Pyridinium Salt.

Sensitizing Dye II: Anhydro-9-ethyl-3,3'-di-(3-sulfoprypyl)-4,5,4',5'-dibenzothiacarbocyanine Hydroxide Triethylamine Salt.

Sensitizing Dye III: Anhydro-9 -ethyl-5,5'-dichloro-3,3'-disulfopropyloxacarbocyanine Sodium Salt.

Sensitizing Dye IV: Anhydro-5,6, 5′,6′-tetrachloro-1,1′-diethyl-3,3′-disulfopropoxyethoxyethylimidazolo-carbocyanine Hydroxide Sodium Salt.

Emulsion IV was produced in the same manner as in Emulsion II of the third layer in Sample A but additionally 8.5 g of Compound H to the organic solvent (100 cc of tricresyl phosphate and 200 cc of ethyl acetate) was added. Sample B was produced in the same manner as in Sample A but Emulsion IV was used instead of Emulsion II.

Samples A and B were exposed uniformly to red light after exposure stepwise to green light. Then they were developed at 38°C by the following processing steps.

| | |
|---|---|
| 1. Color Development | 3 minutes and 15 seconds |
| 2. Bleach | 6 minutes and 30 seconds |
| 3. Rinsing | 3 minutes and 15 seconds |
| 4. Fix | 6 minutes and 30 seconds |
| 5. Rinsing | 3 minutes and 15 seconds |
| 6. Stabilization | 3 minutes and 15 seconds |

Compositions of the processing solutions used in each step were as follows.

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline sulfate | 4.5 g |
| Water to make | 1 liter |
| Bleaching Solution: | |
| Ammonium Bromide | 160.0 g |
| Aqueous Ammonia Solution (28 %) | 25.0 ml |
| Ethylenedizmine-Tetraacetic Acid Sodium Iron Salt | 130 g |
| Glacial Acetic Acid | 14 ml |
| Water to make | 1 liter |
| Fixer: | |
| Sodium Tetrapolyphosphate | 2.0 g |
| Sodium Sulfite | 4.0 g |
| Ammonium Thiosulfate (70 %) | 175.0 ml |
| Sodium Bisulfite | 4.6 g |
| Water to make | 1 liter |
| Stabilizing Solution: | |
| Formalin (40 %) | 8.0 ml |
| Water to make | 1 liter |

Figure 4:
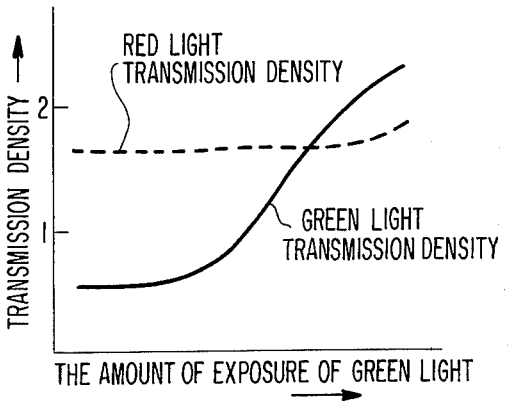
FIG. 4 shows the result obtained using a photosensitive material for comparision.
Figure 5:
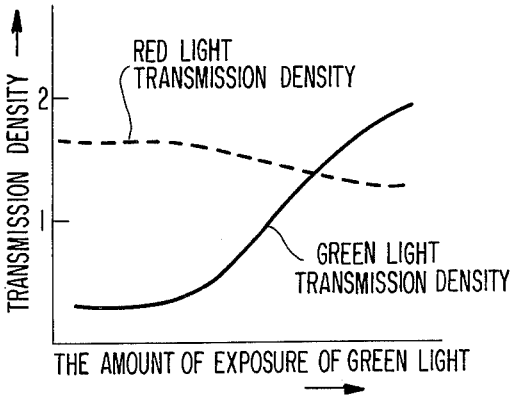
FIG. 5 shows the result obtained using a photosensitive material of the present invention.

The red light transmission density and green light transmission density of Samples A and B developed by the above described processings were determined for the purpose of comparison. The result of the determination for Sample A is shown in FIG. 4 and that of Sample B is shown in FIG. 5. In Sample A, the green light transmission density increases as the exposure by green light increases but the red light transmission density is nearly constant and an overlapping effect of the green sensitive layer on the red sensitive layer is hardly observed. On the contrary, in Sample B, the green light transmission density increases as the exposure by green light increases as in Sample A, but the red light transmission density decreases, and a fairly large overlapping effect of the green sensitive layer on the red sensitive layer is observed. This is caused by Compound H added to the third layer of Sample B.

EXAMPLE 2

Figure 2:
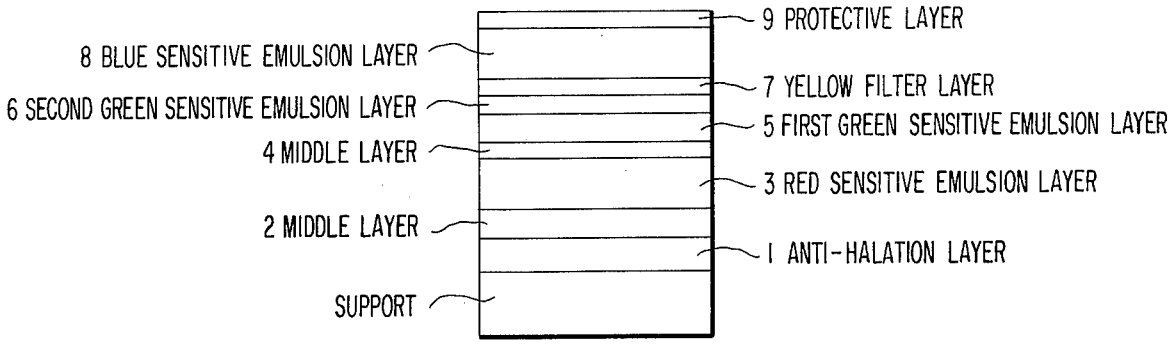

Sample C shown in FIG. 2 comprising layers having the following compositions on a transparent cellulose acetate film support was produced as a multi-layer color photosensitive material.

First Layer: Antihalation Layer

A gelatin layer containing black colloidal silver was coated in a thickness of about 1.5 μ to provide 0.45 g/m² of silver.

Second Layer: Intermediate Layer

A gelatin layer containing dispersed 2,5-di-t-octylhydroquinone was coated in a dry thickness of about 0.7 μ to provide a coverage of $1.6 \times 10^{-4}$ mol/m² of the 2,5-di-t-octylhydroquinone.

| Third Layer: Red-Sensitive Emulsion Layer | |
|---|---|
| Silver Iodobromide Emulsion (iodine: 6 % by mol) | Coated silver content: 1.6 g/m² |
| Sensitizing Dye I (that shown in Example 1) | $3 \times 10^{-5}$ mols per mol of silver |
| Sensitizing Dye II (that shown in Example 1) | $1.2 \times 10^{-5}$ mols per mol of silver |
| Coupler (16) | 0.1 mols per mol of silver |

Fourth Layer: Intermediate Layer

A gelatin layer containing emulsified 2,5-di-t-octylhydroquinone was coated in a dry thickness of about 1.2 μ to provide $2.7 \times 10^{-4}$ mol/m² of 2,5-di-t-octylhydroquinone.

| Fifth Layer: First Green Sensitive Emulsion Layer | |
|---|---|
| Silver Iodobromide Emulsion (iodine: 6 % by mol) | Coated silver content: 1.5 g/m² |
| Sensitizing Dye III (that shown in Example 1) | $3 \times 10^{-5}$ mols per mol of silver |
| Sensitizing Dye IV (that shown in Example 1) | $1 \times 10^{-5}$ mols per mol of silver |
| Coupler (8) | 0.06 mols per mol of silver |

| Sixth Layer: Second Green Sensitive Emulsion Layer | |
|---|---|
| Silver Iodobromide Emulsion (iodine: 4 % by mol) | Coated silver content: 1.7 g/m² |
| Sensitizing Dye III | $2.5 \times 10^{-5}$ mols per mol of silver |
| Sensitizing Dye IV | $0.8 \times 10^{-5}$ mols per mol of silver |
| Coupler (8) | 0.004 mols per mol silver |
| Coupler (10) | 0.013 mols per mol of silver |

Seventh Layer: Yellow Filter Layer

A gelation layer containing an emulsified dispersion of yellow colloidal silver and 2,5-di-t-octylhydroquinone was coated in a dry thickness of about 1.5 $\mu$ to provide a coverage of 1.01 g of silver/m$^2$ and $4.4 \times 10^{-4}$ mol of 2,5-di-t-octylhydroquinone per m$^2$.

| Eighth Layer: Blue Sensitive Emulsion Layer | |
|---|---|
| Silver Iodobromide Emulsion (iodine: 6 % by mol) | Coated silver content: 1.6 g/m$^2$ |
| Coupler (4) | 0.1 mols per mol of silver |

Ninth Layer: Protective Layer

A gelatin layer containing polymethyl methacrylate particles (particle size: about 1.5 $\mu$) was coated in a dry thickness of about 1.2 $\mu$.

To each layer, a gelatin hardening agent, a coating assistant (surface active agent) and a viscosity increasing agent were additionally added.

Sample D was produced in the same manner as in Sample C but 0.009 moles per mol of silver of Compound J were added to the organic solvent phase in the emulsion of the fifth layer and 0.003 mols per mol of silver of Compound J were added to the organic solvent phase of the emulsion of the sixth layer.

Samples C and D were processed to make 35 mm color negative photographic films. The films were exposed using a still camera and developed in the color development steps shown in Example 1 to obtain color negatives.

The color purity, granularity, sharpness and fog of the color negative obtained using Sample D were remarkably better than those obtained using Sample C.

Similar results were obtained when Compounds A, B, C, D, E, F, G, H, I, K, L and M were used alone or as a mixture thereof instead of Compound J in the fifth layer and the sixth layer of Sample D as described in Example 2. Improvements in color purity, granularity, sharpness and fog were also observed in where one or more Compounds selected from Compounds A to L were used together with Coupler (16) in the third layer or Coupler (4) in the fifth and sixth layer.

Further, similar results are obtained where Coupler (8) in the sixth layer and the sixth layer in Sample D was substituted for the couplers described in U.S. Pat. Nos. 3,127,269 and 3,684,514 and U.S. Patent Applications Ser. No. 235,937 filed Mar. 20, 1972 and Ser. No. 319,806, filed Dec. 29, 1972 or Couplers (1), (2), (3), (5), (6) and (7).

EXAMPLE 3

Figure 3:
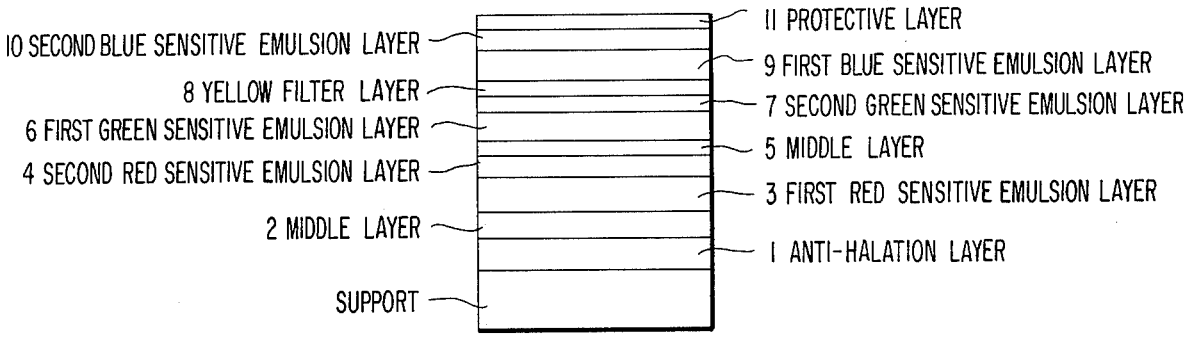

Sample E shown in FIG. 3 comprising layers having the following compositions was produced as a multilayer color photosensitive material.

First Layer: Antihalation Layer

The same composition and coating amount as the first layer of Sample C in Example 2.

Second Layer: Intermediate Layer

The same composition and coating amount as the second layer of Sample C in Example 2.

| Third Layer: First Red-Sensitive Layer | |
|---|---|
| Silver Iodobromide Emulsion (iodine: 6 % by mol) | Coated silver content: 1.1 g/m$^2$ |
| Sensitizing Dye I (that shown in Example 1) | $3 \times 10^{-5}$ mols per mol of silver |
| Sensitizing Dye II (that shown in Example 1) | $1.2 \times 10^{-5}$ mols per mol of silver |
| Coupler (16) | 0.02 mols per mol of silver |
| Coupler (17) | 0.04 mols per mol of silver |

| Fourth Layer: Second Red-Sensitive Emulsion Layer | |
|---|---|
| Silver Iodobromide Emulsion (iodine: 6 % by mol) | Coated silver content: 1.2 g/m$^2$ |
| Sensitizing Dye I (that shown in Example 1) | $6 \times 10^{-5}$ mols per mol of silver |
| Sensitizing Dye II (that shown in Example 1) | $1.5 \times 10^{-5}$ mols per mol of silver |
| Coupler (16) | 0.09 mols per mol of silver |
| Coupler (17) | 0.02 mols per mol of silver |

Fifth Layer: Intermediate Layer

A gelatin layer containing dispersed 2,5-di-t-octylhydroquinone coated in an amount of $2.7 \times 10^{-4}$ mol of 2,5-di-t-octylhydroquinone/m$^2$.

Sixth Layer and Seventh Layer: First and Second Green-Sensitive Emulsion Layers

The same compositions and coating amounts as the fifth and the sixth layers of Example 2 but used Coupler (11) was used instead of Coupler (8).

Eighth Layer: Yellow Filter Layer

The same composition and coating amount as the seventh layer in Example 2.

| Ninth Layer: First Blue-Sensitive Emulsion Layer | |
|---|---|
| Silver Iodobromide Emulsion (iodine: 7 % by mol) | Coated silver content: 1 g/m$^2$ |
| Coupler (4) | 0.25 mols per mol of silver |

| Tenth Layer: Second Blue-Sensitive Emulsion Layer | |
|---|---|
| Silver Iodobromide Emulsion (iodine: 6 % by mol) | Coated silver content: 1.1 g/m$^2$ |
| Coupler (4) | 0.07 mols per mol of silver |

Eleventh Layer: Protective Layer

The same composition and coating amount as the ninth layer in Example 2.

To each layer, a gelatin hardening agent, a coating assistant (surface active agent) and a viscosity increasing agent were added.

Sample F was produced in the same manner as in Sample E but the following compounds respectively were added to the organic solvent phase of the coupler dispersion in the third layer, the fourth layer, the sixth layer or the seventh layer in Sample E.

Third Layer: Compound F 0.01 moles per mol of silver

Fourth Layer: Compound F 0.01 mols per mol of silver

Sixth Layer: Compound H 0.009 mols per mol of silver

Seventh Layer: Compound H 0.002 mols per mol of silver

Samples E and F were processed to make 35 mm color negative photosensitive films. The films were exposed using a still camera and developed in the color development steps shown in Example 1 to produce color negatives.

The color purity, granularity, sharpness and fog of the color negatives obtained using Sample F which contained Compound F or H were remarkably better than those obtained using Sample E. Further, in Sample F, the fog of all of the emulsion layers and particularly the green-sensitive emulsion layers were remarkably inhibited as compared with Sample E. Moreover, it was observed that the fastness to light of the dyes formed by color development and particularly the magenta color images in Sample F was more excellent than that in Sample E.

In the examples, it is possible to modify the photosensitive emulsion layers which form substantially the same color to each other so as to have a one-layer structure or a three-layer structure, or to change the arrangement of GL, RL or BL.

It is also possible to modify the layers incorporating the hydroquinone derivatives or DIR couplers on the basis of the objects and the scope of the present invention.

The present invention can be applied, of course, to conventionally known color negative sensitive materials, color reversal sensitive materials, color printing sensitive materials, color transparent positive sensitive materials and color papers. Further, the elements of the present invention can be easily applied to photosensitive materials for a monochromatic system, for example, color-X-ray sensitive materials and micro-film sensitive materials, and color sensitive materials for a direct positive process.

While the invention has been described in detail and with reference to specific embodiments thereof, it will be apparent to one skilled in the art that various changes and modifications can be made therein without departing from the spirit and scope thereof.

What is claimed is:

1. An incorporated type multi-layer color photographic sensitive material comprising a support having thereon at least two photosensitive emulsion layer units each containing color couplers which form images having a different color from each other by color development, wherein at least one of said photosensitive emulsion layer units comprises two or more individual layers, and at least one of said individual layers contains a hydroquinone derivative for interlayer color correction.

2. The multi-layer color photographic sensitive material of claim 1, wherein said hydroquinone derivative has the general formula (I)

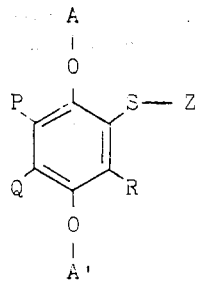

(I)

wherein P, Q and R each represents a hydrogen atom, an alkyl group, an alkenyl group, a hydroxyl group, an alkoxy group, an amino group, an alkylthio group, an aryl group, an arylthio group, a heterocyclic group, or a —SZ group, and wherein P and Q can combine to form a carbocyclic ring; A and A′ each represents a hydrogen atom or an alkaline splitable group selected from the group consisting of an acyl group and an alkoxycarbonyl group; and Z represents a heterocyclic residue, said heterocyclic residue being photographically inactive when combined and released upon development.

3. The multi-layer color photographic sensitive material of claim 2, whrein said heterocyclic residue for Z is a heterocyclic aromatic group selected from the group consisting of a tetrazolyl group, a triazolyl group, a thiadiazolyl group, an oxazolyl group, an oxadiazolyl group, a thiazolyl group and a pyrimidyl group.

4. The multi-layer color photographic sensitive material of claim 1, wherein said hydroquinone derivative is diffusion resistant.

5. The multi-layer color photographic sensitive material of claim 1, wherein said coupler is a magenta dye forming coupler, a yellow dye forming coupler, or a cyan dye forming coupler.

6. The multi-layer color photographic sensitive material of claim 5, wherein said magenta dye forming coupler is a 5-pyrazolone coupler, a cyanoacetylcoumarone coupler or an imidazolone coupler, wherein said yellow-dye forming coupler is an open-chained acylacetanilide coupler, an open-chained acylacetonitrile coupler, an acylacetyl coupler and wherein said cyan dye forming coupler is a naphthol coupler or a phenol coupler.

7. The multi-layer color photographic sensitive element of claim 6 wherein said magenta dye forming coupler is represented by general formula (II)

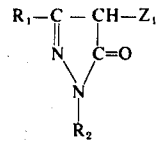

(II)

wherein $R_1$ represents an alkyl group, an aryl group, an alkoxy group, an aryloxy group, a heterocyclic group, an amino group, an acid amide group, or a ureido group; $R_2$ represents an alkyl group, an aryl group, or a heterocyclic group; and $Z_1$ represents a hydrogen atom or a group splitable at color development selected from the group consisting of a thiocyano group, an acyloxy group, an aryloxy group, an alkoxy group, an alkoxycarbonyloxy group, an aryloxycarbonyloxy group, a disubstituted amino group, an arylazo group, a heterocyclic azo group, an arylmonothio group, a heterocyclic monothio group, and a heterocyclic imide group; wherein said yellow dye forming coupler has the general formula (III)

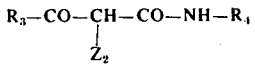

(III)

wherein $R_3$ represents an alkyl group, or an aryl group; $R_4$ represents a phenyl group; $Z_2$ represents a hydrogen atom or a group splitable at color development selected from the group consisting of a halogen atom, an acyloxy group, an aryloxy group, a heterocyclic aromatic carbonyloxy group, an arylsulfoxy group, a dioxoimido group and a dioxythiazolidinyl group; and wherein said cyan dye forming coupler is represented by the general formula (IV) or (V)

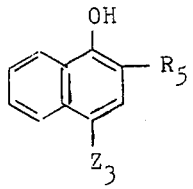

(IV)

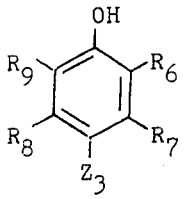

(V)

wherein $R_5$ represents a carbamyl group, a sulfamyl group, an alkoxycarbonyl group or an aryloxycarbonyl group; $R_6$ represents an alkyl group, an aryl group, a heterocyclic group, an amino group, a carboxamido group, a sulfonamido group, a sulfamyl group, or a carbamyl group; $R_7$, $R_8$ and $R_9$ each represents the same groups as defined for $R_6$ additionally a halogen atom or an alkoxy group; and $Z_3$ represents a hydrogen atom or a group splitable at color development selected from the group consisting of a halogen atom, a thiocyano group, an imino group, a cycloimido group, an arylazo group and a heterocyclic azo group.

8. The multi-layer color photographic sensitive material of claim 1 wherein said at least one of said photosensitive emulsion layer units comprises two or more emulsion layers which are sensitive to the same wavelength region.

9. The multi-layer color photographic sensitive material of claim 1, wherein said hydroquinone derivative for interlayer color correction is included in an amount up to about 50 mol % based on the coupler included in the layer to which said hydroquinone derivative is added.

10. The multi-layer color photographic sensitive material of claim 9, wherein said hydroquinone derivative for interlayer color correction is present in an amount of 5 to 20 mol %.

11. The multi-layer color photographic sensitive layer of claim 1, wherein each of the photosensitive emulsion layers present have substantially the same developing rate.

12. The multi-layer color photographic sensitive material of claim 11, wherein each emulsion layer unit comprises a plurality of emulsion layers sensitive to the same wavelength region which have substantially the same developing rate.

13. The multi-layer color photographic sensitive element of claim 1, wherein said hydroquinone derivative for interlayer color correction releases a diffusable color development inhibitor at color development which selectively inhibits color development of an adjacent photosensitive emulsion layer.

14. The multi-layer color photographic sensitive element of claim 8, wherein said hydroquinone derivative for interlayer color correction releases a diffusable color development inhibitor at color development which selectively inhibits color development of an adjacent photosensitive emulsion layer.

* * * * *